United States Patent [19]

Den Bleyker

[11] Patent Number: 4,880,438

[45] Date of Patent: Nov. 14, 1989

[54] DIP TUBE WITH JACKET

[75] Inventor: Alfred L. Den Bleyker, Houston, Tex.

[73] Assignee: Texaco Inc., White Plains, N.Y.

[21] Appl. No.: 311,266

[22] Filed: Apr. 10, 1989

[51] Int. Cl.[4] ..... C10J 3/48; C10J 3/84

[52] U.S. Cl. ..... 48/69; 48/DIG. 2

[58] Field of Search ..... 48/69, 77, DIG. 2, 128, 48/63, 64, 76, 62 R; 55/256, 257.5; 110/171; 422/207; 261/112

[56] References Cited

U.S. PATENT DOCUMENTS

| | | | |
|---|---|---|---|
| 4,444,726 | 4/1984 | Cotty et al. | 48/69 |
| 4,474,584 | 10/1984 | Koog | 48/DIG. 2 |
| 4,605,423 | 8/1986 | Koog | 48/DIG. 2 |
| 4,624,683 | 11/1986 | Dach | 48/69 |
| 4,778,483 | 10/1988 | Martin et al. | 48/DIG. 2 |
| 4,808,197 | 2/1989 | Ayers | 48/69 |

*Primary Examiner*—Peter Kratz

*Attorney, Agent, or Firm*—Robert A. Kulason; James J. O'Loughlin; Robert B. Burns

[57] ABSTRACT

In a gasification reactor having a shell, a combustion chamber in the shell, and a burner positioned to direct a carbonaceous fuel mixture into the combustion chamber. A quench chamber within the shell holds a cooling bath into which the hot effluent resulting from the combustion is cooled. A throat communicating the combustion chamber with the quench chamber guides the hot effluent stream toward the bath. A quench ring positioned beneath the throat supports a water jacketed dip tube which guides the hot effluent into contact with the bath liquid. Liquid coolant passed through the jacket cools the dip tube and thereafter wets the dip tube effluent guide passage.

4 Claims, 2 Drawing Sheets

DIP TUBE WITH JACKET

BACKGROUND OF THE INVENTION

In the production of a usable gas by the combustion of a carbonaceous fuel, the process is operated most effectively in a gasifier or reactor under high temperature and high pressure conditions. For example, for the efficient production of a synthesis gas from a particulated coal or coke, a preferred operating temperature range of about 2400° to 2600° F. is maintained, at a pressure of between about 5 to 250 atmospheres.

The harsh operating conditions prevalent in such a method, and in particular the wide temperature variations experienced, imposes a severe strain on many segments of the gasifier or reactor unit. A reactor of this type is normally furnished with thermal insulation as well as with a system to cool interior parts. Usually such parts as the dip tube that contacts the hot effluent gases, must have adequate cooling if the usable life of this member is to be preserved.

The present invention is addressed to an improvement in the structure of a gasifier, and particularly in the gasifier's quench ring and cooling water distribution system including the cooling water distribution manifold. The latter, by its inherent function, is exposed to maximum temperature conditions and destructive gases. This occurs by virtue of the hot synthesis gas which comes in direct contact with the quench ring and manifold as the hot effluent passes from the combustion chamber, into a cooling or quenching zone.

In the usual reactor structure, the combustion chamber within the reactor shell is lined with a refractory material to avoid thermal damage to the shell. This refractory material can take the form of individual bricks or it can be in the configuration of a unitary member shaped of a castable refractory material. In either instance, the refractory blocks or members are combined and shaped to define the gasifier's constricted throat.

The refractory throat members are normally supported in a way that they can be removed if required for repair or replacement. One form of support resides in placing the quench ring in such a position that it will support the throat from the underside. Thus, the quench ring, which is fastened to the shell wall, will locate the supported throat.

However, during a shut down period, it is probable that in the course of normal cooling, metallic segments of the gasifier such as the quench ring and its auxiliary parts will cool rapidly. This will allow quick access to the reactor interior for performing necessary repair or maintenance work.

Where the reactor's quench ring requires removal from the gasifier for repair or replacement, it is necessary to first detach the refractory blocks which make up the constricted throat. These non-metallic members take a much longer period of time to cool down than does the metallic quench ring. Thus as a practical matter, it can be several days before one can obtain safe access to the reactor interior to permit removal of the quench ring. Furthermore, removal of the throat refractory necessitates the expense of its replacement. This follows, since used fire brick, once disturbed, cannot be reassembled correctly.

In the instance of the gasifier dip tube, this member is exposed to the harsh conditions in the normal course of operating. Even though the dip tube guide surface is wetted by a coolant stream, the dip tube is still subject to thermal damage after a period of time. This results not only from the contact between the flowing gas and the dip tube surface, but also due to the thermal stresses.

Toward overcoming these persistent operating problems, and to minimize gasifier down time and throat replacement, the present invention embodies a gasifier structure wherein the constricted throat between the combustion chamber and the quench chamber is formed of one or more refractory blocks. The latter are supported in place by a quench ring having a separable manifold section. Thus, when the exposed hot face of the dip tube assembly is damaged to the point of needing repair, it can be readily removed without disturbing the quench ring which remains in place supporting the refractory throat.

The water carrying manifold section which maintains a coolant stream against the reactor's dip tube, is detachably fixed to the water conducting quench ring. In a preferred construction, the respective manifold and quench ring, are provided with a thermally resistant gasket compressed between mating surfaces to minimize the flow of heat therebetween. Thus, the refractory member or members which define the constricted throat need not be disturbed when the manifold is removed. Further, the thermally resistant gasket between the mating or engaged members minimizes heat transfer therebetween.

To facilitate and protect the dip tube, the latter is provided with a liquid flow, normally a stream of water. This flow wets the interior surface of the tube thereby affording it a substantial degree of protection from the hot gaseous effluent which often carries solid particulate matter. To improve the flow of water from the quench ring onto the dip tube assembly, from whence it is directed against the dip tube surface, the dip tube is provided with a jacket. Said jacket functions as an intermediary or surge chamber for the liquid prior to its passing into the distribution ring or channel. In the latter, the liquid functions to cool or transfer heat from the normally hot face of the exposed member, thereby minimizing the thermal damage to portions of the quench ring.

In terms of economics, the cooperative arrangement of the quench ring and the dip tube assembly, permits the latter to be completely removed while leaving the supporting ring in place. Shut down time of the gasifier can therefore be reduced by several days through use of the disclosed separable quench ring and cooled dip tube arrangement. Thus, the quench ring is adapted to removably receive the dip tube assembly which is comprised basically of the dip tube guide surface as well as a water distribution channel.

It is therefore an object of the invention to provide an improved gasification reactor having a jacketed dip tube assembly for guiding hot effluent from the reactor's combustion chamber into the liquid cooling bath.

A further object is to provide a dip tube assembly that is readily detachable from a quench ring to facilitate access to the reactor's interior.

A still further object is to provide an improved dip tube cooling system for a gasifier reactor by providing a surge chamber about the dip tube thereby to decrease the possibility of thermal damage thereto.

Another object is to provide a multi-segmented quench ring for a gasification reactor, which can be disassembled and removed piecemeal from the refractory's interior.

DESCRIPTION OF THE DRAWINGS

Referring now to FIG. 1, a gasifier or reactor 10 of the type contemplated embodies an elongated metallic steel walled shell 11. The shell is normally operated in an upright position to permit a downflow of the hot effluent product. Shell 11 includes a reaction or combustion chamber 12 at the upper end. To withstand operating temperatures between 2,000° to 3,000° F., chamber 12 is provided with a lined inner wall 13, preferably formed of a refractory material.

Figure 1:
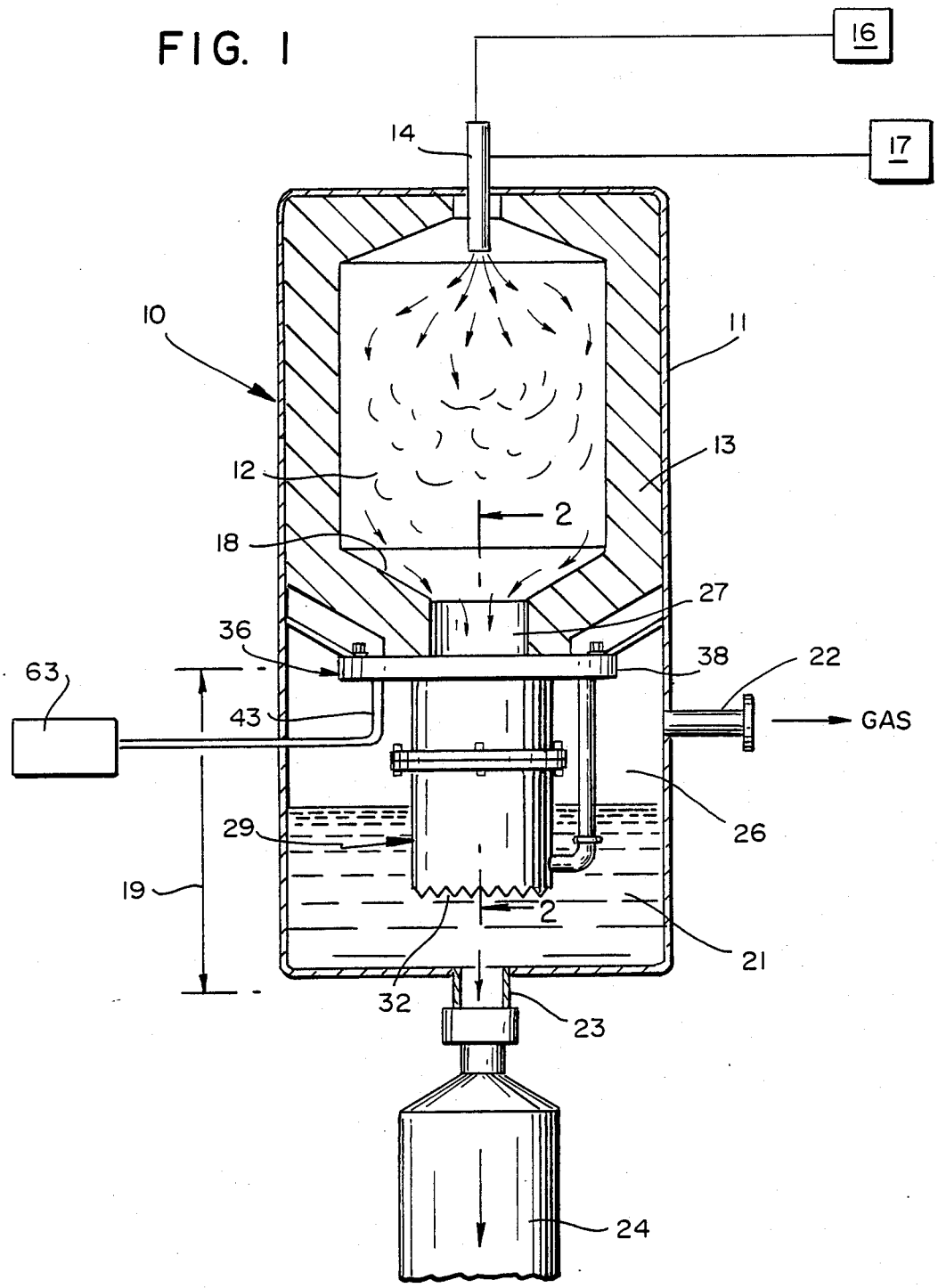
FIG. 1 is an elevation view in cross-section of a reactor of the type contemplated.

A burner 14 is removably positioned at shell 11 upper wall to inject the carbonaceous fuel mixture such as particulated coal or coke from source 16, into reaction chamber 12. An amount of a combustion supporting gas from a pressurized source 17 is concurrently fed into burner 14 to form a desired fuel mixture.

The invention can be applied equally as well to gasifiers which burn a variety of carbonaceous solid, liquid, or gaseous fuels. To illustrate the instant embodiment, however, it will be assumed that burner 14 is communicated with a source 16 of coke. The latter is preferably preground and formed into a slurry of desired consistency by addition of a sufficient amount of water. The pressurized combustion supporting gas at source 17 is normally oxygen, air, or a mixture thereof.

The lower end of reaction chamber 12 is defined by a downwardly sloping refractory floor 18. This configuration enhances the discharge of hot gas and liquefied slag from the reaction chamber 12.

The lower end of shell 11 includes a quench chamber 19 into which the products of gasification are directed. Here, both solid and gaseous products contact liquid coolant bath 21, which is most conveniently comprised of circulating water. The cooled gas emerges from quench bath 21 into disengaging zone 26 before leaving the quench chamber through line 22.

Cooled, substantially particle free gas can no be processed in downstream equipment and operations into a usable form. The solid or slag component of the effluent sinks through bath 21 to be removed by way of discharge port 23 into lockhopper 24.

Reaction chamber 12 and quench chamber 19 are communicated trough constricted throat 27 formed in the reaction chamber floor 18. To achieve efficient contact of the hot effluent which leaves reaction chamber 12, with liquid in bath 21, quench chamber 19 is provided with dip tube assembly 29 having an upper side positioned adjacent to constricted throat 27. Dip tube assembly 29 further includes a lower edge 32 which terminates in coolant bath 21 thereby defining an effluent guide path along the dip tube inner surface 28.

Figure 2:
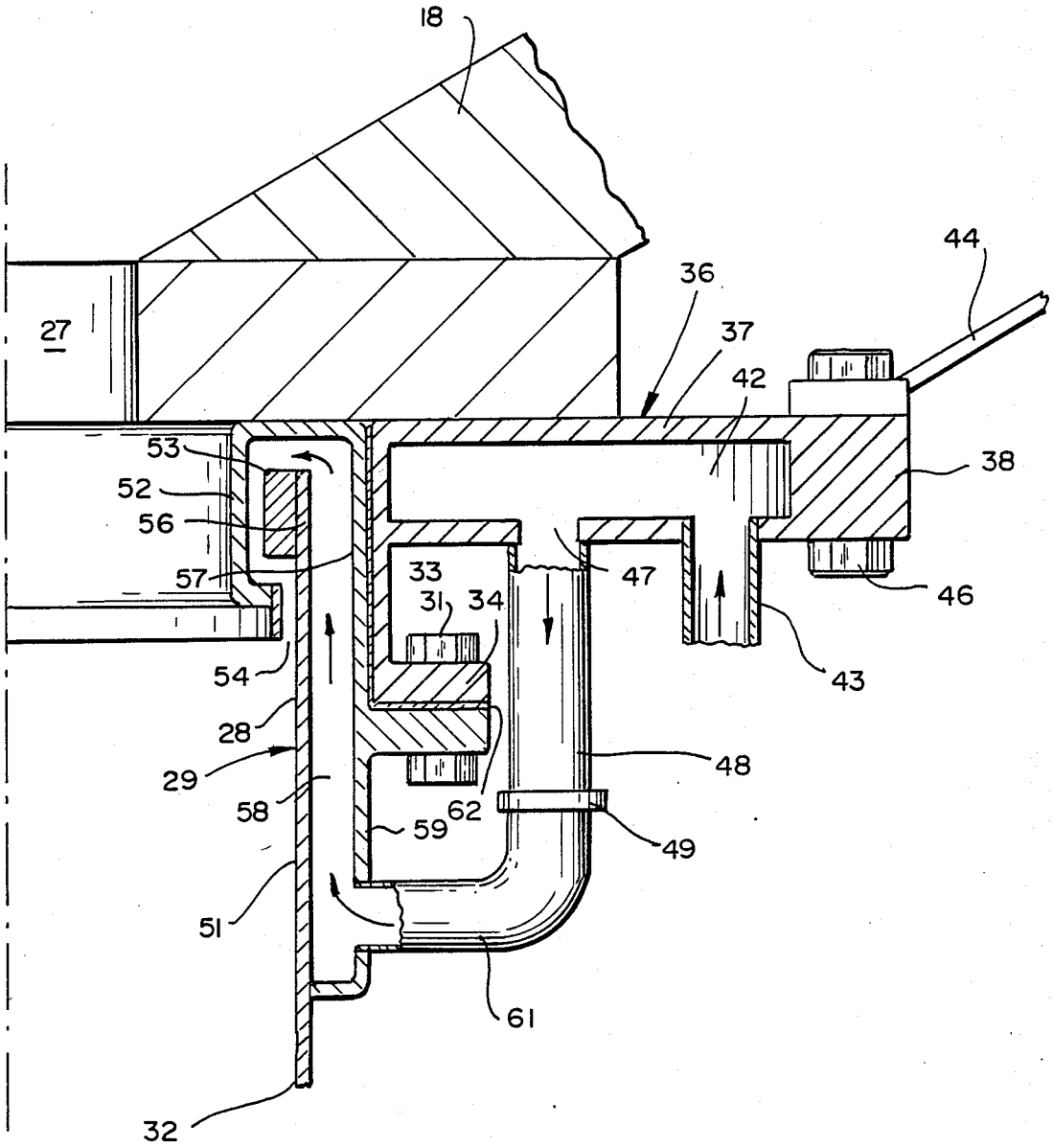
FIG. 2 is a cross-sectional view taken along line 2—2 of FIG. 1.

Referring to FIG. 2, constricted throat 27 defines the initial guide passage through which the high temperature, high pressure effluent passes, prior to entering the effluent guide path defined by the dip tube inner surface 28.

In one embodiment of the invention, quench ring 36 is comprised of a main toroidal ring or body 37 having a side wall 38 which defines a periphery to the quench ring. A second or inner wall forms an engaging surface to which dip tube assembly 29 removably fastens.

Quench ring 36 includes a liquid circulating chamber or passage 42 communicated at its lower side with a pressurized source 63 of the cooling liquid by way of conduit 43. The coolant, as noted, is preferably water, maintained under a pressure in excess of the gasifier pressure. The upper wall of quench ring 36 as shown, is supportably engaged with a stiffener ring or bracket 44. A plurality of peripherally spaced fastening bolts and nuts 46 engage the two members into tight relationship Stiffener ring 44 firmly positions the toroidal quench ring body 37 such that it forms a circular shelf or lower support element for the refractory segments which make up the constricted throat 27 and floor 18.

Quench ring 36 includes an elongated inner rim 33 which defines a cylindrical engaging surface. Preferably, said engaging surface is substantially cylindrical in conformation or is outwardly flared in a downward direction to facilitate removable registry of the corresponding mating segment of dip tube assembly 29.

Said elongated rim 33 extends downwardly and terminates in a peripheral flange 34. The latter includes a bolt circle having a series of bolt holes spaced to receive connecting bolts 31.

Liquid circulating passage 42 includes a lower surface having one or more risers 43 communicated therewith which furnish an inflow of the pressurized water to said passage. The water, after circulating through chamber 42, will cool the entire ring, particularly the upper surface which contacts the gasifier floor 18. The water will then be forced outward through a discharge opening or opening 47 into an elongated connector 48 which extends downwardly to terminate in a flange connection 49.

Dip tube assembly 29 is comprised primarily of dip tube 51 which is in the general conformation of a cylindrical member formed of one or more segments. The tube defines along its internal surface 28, a guide path which allows downwardly flowing effluent to be guided toward and into water bath 21.

The cylindrical, metallic dip tube includes as noted inner surface 28 which defines the first contact said member has with the hot, downwardly flowing effluent. Said surface, because of its exposure to the heated abrasive conditions, requires some form of cooling or other protection from the detrimental affects which will otherwise result from the hot operating temperatures.

Body 52 is provided with an inner circulatory channel 53 which receives liquid coolant and thereafter circulates it and forces the liquid down along the inner surface 28 of the dip tube by way of a constricted opening 54.

Toroidal body 52 includes an inner wall 56 whose primary function is to engage and support the upper end of elongated dip tube 51. The latter is welded at specific points to the said inner wall 56 in a manner that the dip tube will be supported in place during the most difficult gasifier operating conditions.

Dip tube assembly 29 is further comprised of an external elongated guide wall 57 which slidably registers within the central opening defined by the quench tube rim 33.

To protect the external surface of dip tube 51 from damage due to thermally induced stress, as well as to cool the entire dip tube, the latter is provided with a water circulating jacket 58 defined between the dip tube external surface, and a cylindrical panel 59. The latter is spaced from the dip tube and fastened to the lower end thereof. The panel upper end forms an elongated extension to the wall of toroidal body 52.

One or more inlet ports 61 formed at the jacket 58 lower end, accommodate downwardly extending connector conduit 48. Functionally, during a gasification operation, as pressurized coolant water is introduced to chamber 42 by way of risers 43, it circulates through said chamber to cool the entire unit thereby protecting the upper surface from adverse affects due to supporting contact with the refractory floor 18. The coolant water is then forced through the conduits 48, and enters jacket 58 lower end. The water is then urged upwardly through jacket 58 and thereafter through the discharge opening 54 against inner surface 28 of the dip tube.

To assure the water tight integrity between quench ring 36 and dip tube assembly 29, gasket 62 is compressed between the two members. The gasket is formed of a durable, inert, yet temperature resistant material such as asbestos or asbestos substitutes.

When it becomes necessary to remove dip tube assembly 29 for repair or replacement, it is necessary only to disengage connecting bolts 31 from support flange 34, thereby releasing the gasket 62. The respective conduits 48 can then be disconnected by breaking joint 49. In an open condition, the entire dip tube assembly 29 can be lowered and disengaged from the quench ring 36. The dip tube assembly can either be further disassembled into smaller segments, or removed as a unit from the gasifier lower end.

During such a repair or replacement operation, removal of the dip tube assembly 29 will have no affect on the supported refractory. The latter will be maintained in place by the fixedly positioned quench ring 36.

It is understood that although modifications and variations of the invention can be made without departing from the spirit and scope thereof, only such limitations should be imposed as are indicated in the appended claims.

I claim:

1. In a gasification reactor for combusting a carbonaceous fuel to produce a hot effluent stream comprised primarily of a usable gas, said reactor including:

an elongated shell, means forming a refractory lined combustion chamber in said shell, burner in said shell communicated with a pressurized source of a carbonaceous fuel mixture, to discharge a flow of the fuel mixture into the combustion chamber, means forming a quench chamber in said shell including a liquid bath beneath said combustion chamber, means forming a constricted throat communicating the combustion chamber with said quench chamber for conducting said produced hot effluent stream, a quench ring in said quench chamber having means forming an annular coolant chamber communicated with a pressurized water source, a dip tube assembly depending from said quench ring and including:

a toroidal body having an annular channel and at least one discharge port from said channel, a cylindrical dip tube depending from said toroidal body having an inner surface which defines a guide passage for the hot effluent leaving the combustion chamber and having an outer surface, a panel spaced from said dip tube and depending therefrom to define an intermediate jacket communicated with the annular coolant chamber and with said annular channel, respectively, said at least one discharge port being directed into said dip tube guide passage.

2. In the apparatus as defined in claim 1, wherein said dip tube assembly includes:

a dip tube jacket which extends substantially the entire length of the dip tube external surface.

3. In the apparatus as defined in claim 1, including gasket means being compressed between the respective dip tube assembly and said quench ring assembly.

4. In the apparatus as defined in claim 1, wherein said jacket extends into and below the surface of the water bath.

* * * * *